US006303886B1

(12) United States Patent
Stoughton

(10) Patent No.: US 6,303,886 B1
(45) Date of Patent: Oct. 16, 2001

(54) POWER MANAGEMENT SENSING ROTATING PLATTER WITH LIQUID CONTACT SWITCH RESPONSIVE TO PLATTER ROTATIONAL SPEED

(75) Inventor: John W. Stoughton, Indianapolis, IN (US)

(73) Assignee: UMM Electronics, Indianapolis, IN (US)

( * ) Notice: Subject to any disclaimer, the term of this patent is extended or adjusted under 35 U.S.C. 154(b) by 0 days.

(21) Appl. No.: 09/504,506

(22) Filed: Feb. 15, 2000

(51) Int. Cl.[7] ..... H01H 29/20; H01H 35/10

(52) U.S. Cl. ..... 200/220; 200/61.47; 200/80 A; 200/224; 200/229

(58) Field of Search ..... 200/33 A, 61.47, 200/80 A, 182–236

(56) References Cited

U.S. PATENT DOCUMENTS

| | | | | |
|---|---|---|---|---|
| 892,576 | | 7/1908 | Brown | 200/221 X |
| 923,129 | | 5/1909 | Schweitzer et al. | 200/221 X |
| 1,638,133 | | 8/1927 | Walker | 200/217 |
| 1,711,689 | | 5/1929 | Pierce et al. | 200/188 |
| 1,900,080 | | 3/1933 | Snavely | 200/204 |
| 2,895,330 | * | 7/1959 | Erisman | 200/188 X |
| 3,778,803 | * | 12/1973 | Jahn | 200/230 X |
| 3,935,669 | * | 2/1976 | Potrzuski et al. | 200/80 A X |
| 4,122,334 | * | 10/1978 | Owens | 200/220 X |
| 4,221,278 | * | 9/1980 | Ponzo | 200/220 X |
| 4,434,337 | | 2/1984 | Becker | 200/220 |
| 4,497,118 | | 2/1985 | Byrum | 33/366 |
| 5,034,582 | | 7/1991 | DiMaggio | 200/220 |
| 5,751,074 | | 5/1998 | Prior et al. | 307/118 |

* cited by examiner

*Primary Examiner*—J. R. Scott
(74) *Attorney, Agent, or Firm*—Woodard, Emhardt, Naughton, Moriarty & M^c^Nett

(57) ABSTRACT

The present invention relates to an electrical switch including an arcuate cavity partially filled with an electrically conducting fluid. The fluid is adapted to move into electrical contact with a pair of electrodes positioned within the cavity in response to a rotational force acting thereupon. The switch is electrically connectable to a rotatable platter. When connected to the platter, the switch is positioned radially outward from the platter's axis of rotation, such that the forces generated by the platter upon rotation urge the electrically conducting fluid into contact with the electrodes and thus complete a circuit.

18 Claims, 6 Drawing Sheets

POWER MANAGEMENT SENSING ROTATING PLATTER WITH LIQUID CONTACT SWITCH RESPONSIVE TO PLATTER ROTATIONAL SPEED

TECHNICAL FIELD OF THE INVENTION

The present invention relates generally to electrical switches and, more particularly, to an apparatus for automatically switching an electrical circuit when a platter is rotated.

BACKGROUND OF THE INVENTION

Many medical analytical techniques, such as blood and urine analysis, rely on centrifugation as part of the testing procedure. Generally, automated devices designed to perform these tests include a built-in centrifuge having a rotatable platter or carousel in which fluid samples are mounted. It is often desirable to separate the carousel rotating function from the analytical functions, in order to conserve resources such as power and/or computer time. Power conservation is especially important if the device is battery operated. To this end, it is attractive to include switching means in the rotatable platter capable of switching on the analytical functions only after the platter has achieved a predetermined rotational rate.

One way of performing this switching function is to rely on the user to activate the analytical function when the platter is rotating at the proper speed. This switching method suffers from the disadvantages of requiring the user to spend valuable time and attention manually actuating the analytical functions of the device. Moreover, manual actuation is not as reliable as an automatic switching means.

One automatic switching means involves the connection of a mechanical switch to the platter. While more reliable than manual switching, mechanical switches are prone to error arising from dirty electrical contacts, broken or worn springs, and broken or worn actuators. Moreover, mechanical switches rely on moving parts with lifetimes adversely affected by the rotational forces generated by the rotating platter.

There is therefore a need for a non-mechanical switch usable with a rotatable platter capable of actuating an electrically connected device, such as an analytical device, upon rotation of the platter to a predetermined speed. The present invention addresses this need.

SUMMARY OF THE INVENTION

The present invention relates to an electrical switch including an arcuate cavity partially filled with an electrically conducting fluid. The fluid is adapted to move into electrical contact with a pair of electrodes positioned within the cavity in response to a rotational force acting thereupon. The switch is electrically connectable to a rotatable platter. When connected to the platter, the switch is positioned radially outward from the platter's axis of rotation, such that the forces generated by the platter upon rotation urge the electrically conducting fluid into contact with the electrodes and thus complete a circuit.

One form of the present invention relates to an electrical switch including a cavity partially filled with an electrically conducting fluid adapted to move into electrical contact with a pair of electrodes positioned within the cavity in response to a rotational force acting thereupon. The switch is adapted to be operationally connected to a rotatable platter and spaced radially from the platter's axis of rotation, such that the forces generated upon rotation of the platter urge the electrically conducting fluid into contact with the electrodes, thus completing a circuit.

Another form of the present invention relates to an electrical switch formed as part of a modular cartridge and including a cavity formed in the cartridge and partially filled with an electrically conducting fluid. The electrically conducting fluid is adapted to move in response to a rotational force acting thereon and into electrical contact with a pair of electrodes positioned within the cavity. The cartridge is operationally connectable to a rotatable platter through matable electrical contacts positioned in both the cartridge and the platter. Rotation of the platter urges the electrically conducting fluid into contact with the pair of electrodes, thus completing a circuit.

One object of the present invention is to provide an improved apparatus for electrical switching in response to a change in angular momentum. Related objects and advantages of the present invention will be apparent from the following description.

BRIEF DESCRIPTION OF THE DRAWINGS

FIG. 6A is a cross-sectional illustration of the electrical switch of the of FIG. 5 having electrically conducting fluid occupying a second position.

DETAILED DESCRIPTION OF THE PREFERRED EMBODIMENT

Figure 1:
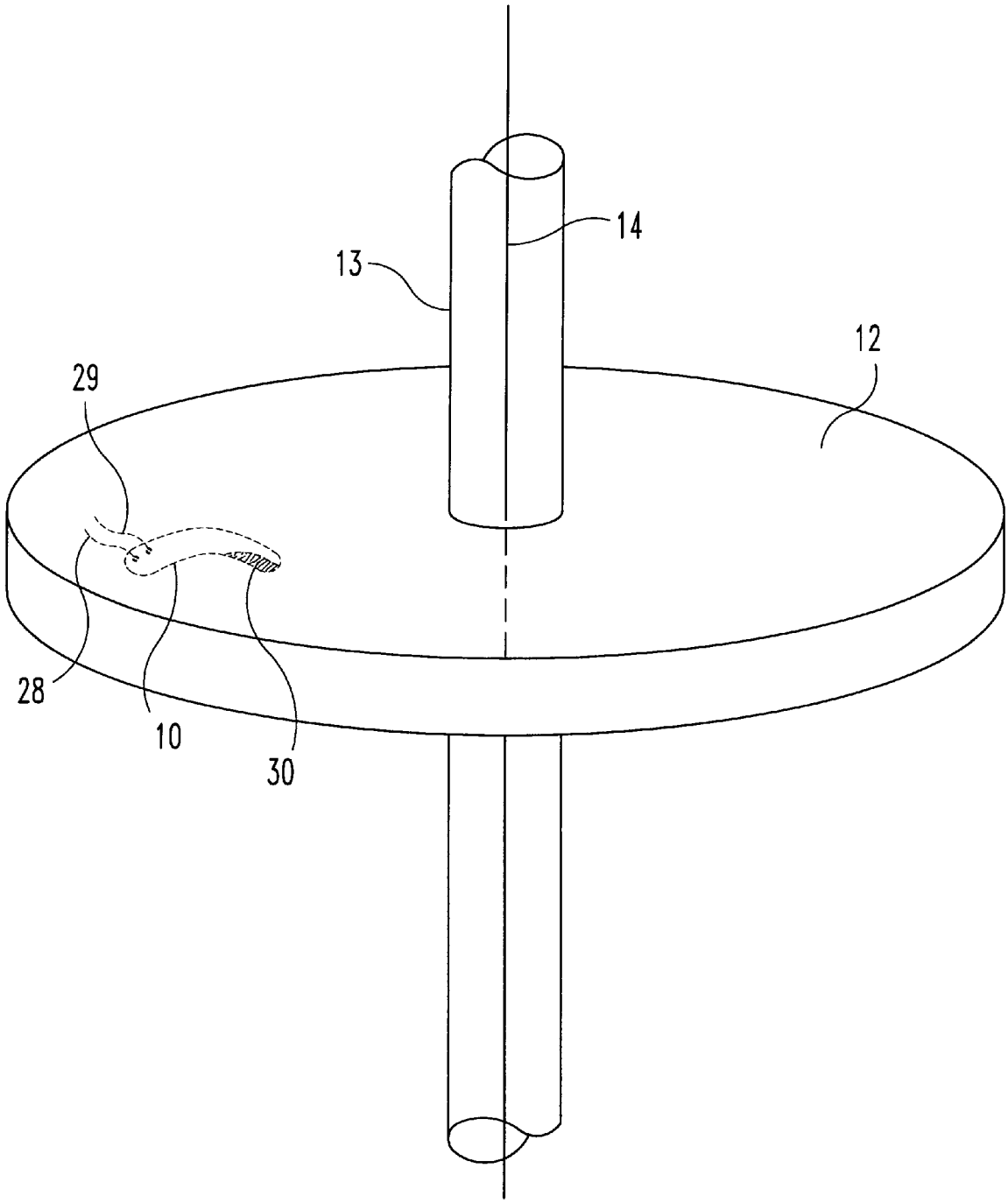
FIG. 1 is a perspective schematic view of a rotatable platter containing a first electrical switch embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
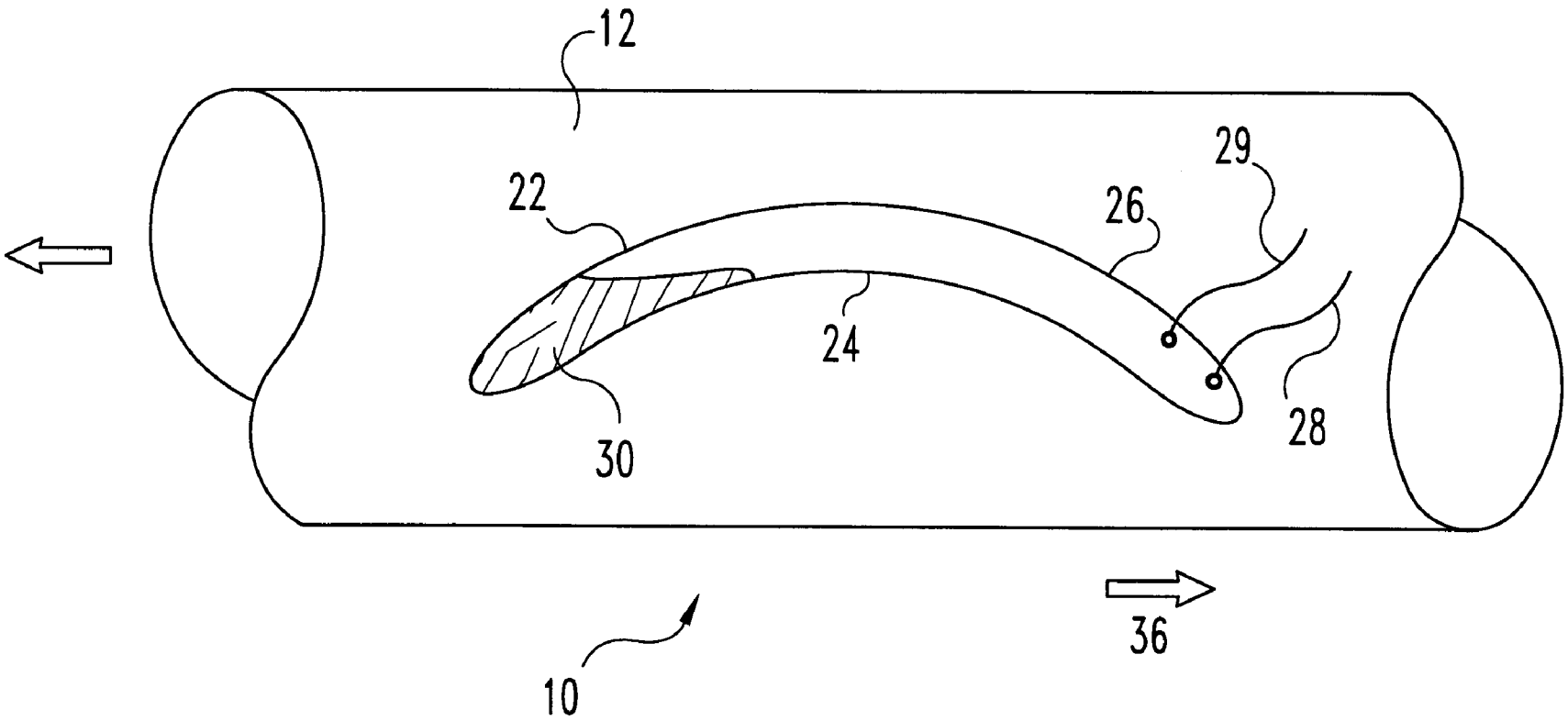
FIG. 2 is a cross-sectional illustration of the electrical switch of the embodiment of FIG. 1.

The present invention relates to an apparatus for closing an electrical circuit in a rotatable member in response to rotation of that member. FIGS. 1 and 2 illustrate one embodiment of the present invention, a rotation-actuated electrical switch 10 positionable in a rotatable platter 12. FIG. 1 illustrates the preferred positioning of switch 10 within platter 12. Rotatable platter 12 preferably has a generally circular shape and rotates about shaft 13. Platter 12 is more preferably generally planar and includes a primary axis of rotation 14 substantially colinear with shaft 13 and substantially perpendicular to platter 12. Switch 10 is preferably formed integrally within platter 12, but may also be formed separately from platter 12 and connected thereto by any convenient means, such as through a modular cartridge (see FIGS. 3 and 4). Switch 10 preferably extends generally radially outward from axis of rotation 14. More preferably, axis of rotation 14 does not intersect switch 10.

FIG. 2 illustrates switch 10 in greater detail. Switch 10 comprises an elongated enclosure or compartment 20 defining a cavity, at least a portion of which is generally arcuate or substantially arch-shaped. Preferably, enclosure 20 has a simple arcuate shape, but may also have any convenient shape incorporating an arched or likewise bent portion, such as a "dogleg" shape or the like. The generally arcuate enclosure 20 has a proximal portion (or inner leg) 22, a middle portion 24, and a distal portion (or outer leg) 26. Middle portion 24 may range in size from large enough to occupy a majority of enclosure 20 to just large enough to connect proximal portion 22 to distal portion 26. Enclosure 20 is preferably positioned relative axis of rotation 14 such that proximal portion 22 is the closest portion to axis of rotation 14. More preferably, proximal portion 22 extends upwardly through platter 12 to middle portion 24. Middle portion preferably extends from proximal portion 22 away from axis of rotation 14 to distal portion 26. Distal portion 26 extends from middle portion 24 downwardly through platter 12 and away from axis of rotation 14. As used herein, the term "upwardly" indicates a direction generally opposite the pull of gravity, such that a body moving upwardly would gain gravitational potential energy. Likewise, the term "downwardly" indicates a direction generally congruent with the pull of gravity, such that a body moving downwardly would lose gravitational potential energy.

Switch 10 also includes a pair of spaced electrical contacts 28, 29 adapted to electrically connect the interior of distal portion 26 to the exterior of switch 10. Switch 10 further includes an electrically conducting fluid 30 (such as mercury or an aqueous electrolytic solution) partially filling the enclosure 20. Fluid 30 preferably rests in proximal portion 22 of switch 10 when platter 12 is at rest. Preferentially, switch 10 is oriented such that distal portion 26 is positioned generally radially outward from proximal portion 22 relative to primary axis of rotation 14. More preferentially, switch 10 is also oriented such that proximal portion 22 and distal portion 26 are positioned below (i.e., having less gravitational potential energy than) middle portion 24.

Rotation of platter 12 generates a radially outwardly acting force (represented by arrow 36) urging fluid 30 into distal portion 26 of switch 10 and into contact with the pair of spaced electrical contacts 28, 29. Force 36 is proportional to the rate of rotation of platter 12. As platter 12 is rotated beyond a predetermined threshold rate, the value of force 36 becomes sufficient to displace fluid 30 from proximal portion 22 to distal portion 26 of switch 10 and into electrical contact with the pair of spaced electrical contacts 28, 29, thus completing an external electrical circuit (not shown) coupled to spaced electrical contacts 28, 29 and enabling current to flow between spaced electrical contacts 28, 29.

The threshold rate of rotation at which fluid 30 becomes displaced into distal portion 26 may be predetermined by varying the amount of fluid 30, the composition (specifically, the viscosity and/or density) of fluid 30, and/or varying the curvature of enclosure 20. Generally, as the density and/or viscosity of fluid 30 increases, a greater force 36 will be required to displace fluid 30 into distal portion 26. Likewise, as enclosure 20 becomes more arcuate (or as the slope from inner leg 22 to middle portion 24 becomes steeper), a greater force 36 will be required to displace fluid 30 into distal portion 26. By choosing the appropriate degree of curvature of enclosure 20 and amount and composition of fluid 30, the rotation rate of platter 12 at which switch 10 trips may be predetermined. After switch 10 has been subjected to rotational force 36 and tripped, switch 10 may be disengaged and reset by repositioning enclosure 20 such that fluid 30 flows from distal portion 26 back into proximal portion 22. This operation may be performed manually or automatically.

Figure 3:
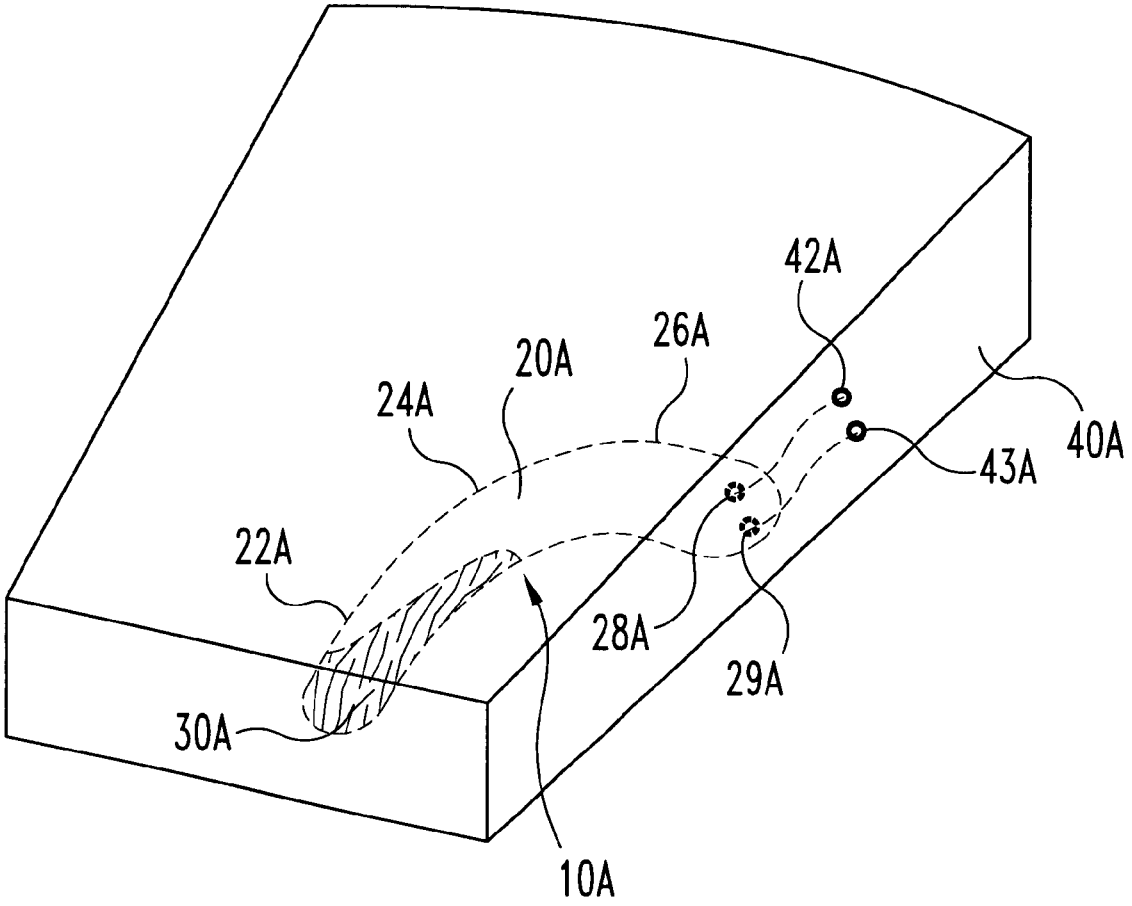
FIG. 3 is a perspective view of a cartridge containing a second electrical switch embodiment of the present invention.
Figure 4:
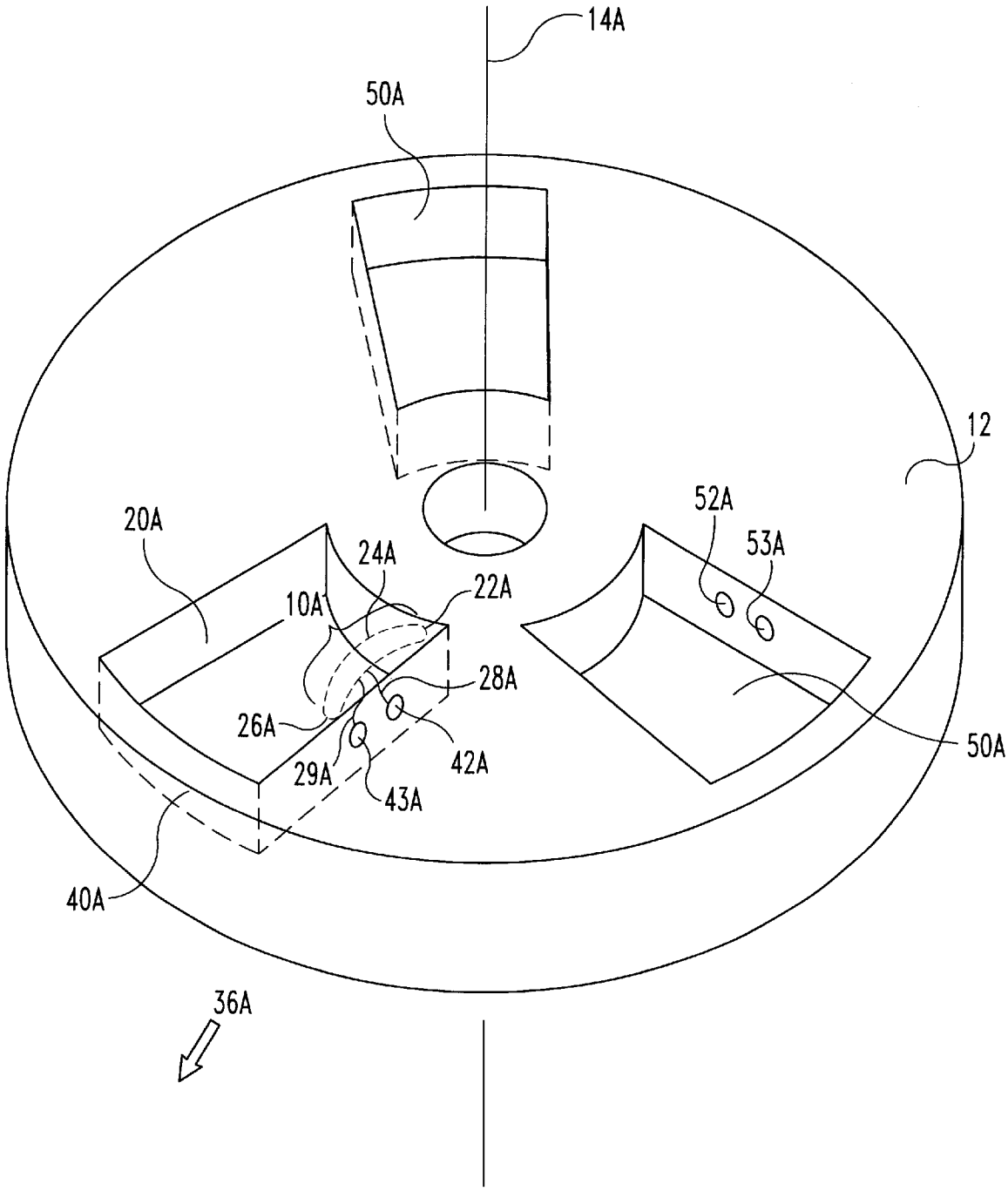
FIG. 4 is a perspective schematic view of the cartridge of FIG. 3 inserted in a rotatable platter.

FIGS. 3 and 4 illustrate a second embodiment of the present invention, a switch 10 formed in a modular cartridge 40A adapted to be electrically connected to a rotatable platter 12A. FIG. 3 illustrates cartridge 40A in detail. Cartridge 40A includes a substantially arcuate or generally arch-shaped elongated enclosure or compartment 20A defining a cavity having an upwardly-inclined proximal portion or inner leg 22A, a middle portion 24A, and a downwardly-inclined distal portion or outer leg 26A, whereas the inclinations of the proximal and distal portions 22A, 26A are relative to the cartridge 40A orientation when electrically connected to rotatable platter 12A (see FIG. 4). Switch 20A also includes a pair of spaced electrical contacts 28A, 29A adapted to electrically connect the interior of distal portion 26A to the exterior of the switch 10A. First and a second electrical lead 28A and 29A extend from within distal portion 26A of enclosure 20A to the exterior of cartridge 40A and terminate in cartridge electrodes 42A and 43A. Switch 10A further includes an electrically conducting fluid 30A partially filling the enclosure 20A.

FIG. 4 illustrates cartridge 40A as operationally connected to platter 12A. Fluid 30A preferably rests in proximal portion 22A of switch 10A when cartridge 40A is inserted into resting platter 12A. Preferentially, switch 10A is oriented such that distal portion 26A is positioned generally radially outward from proximal portion 22A, relative to primary axis of rotation 14A. In other words, as positioned within cartridge 40A as inserted into platter 12A, switch 10A extends generally radially outward from axis of rotation 14A and has the form of an elongated enclosure 20A having an upwardly-inclined elongated proximal portion 22A and a downwardly-inclined elongated distal portion 26A and is positioned relative to platter 12A such that upwardly-inclined proximal portion 22A lies radially inward relative to middle portion 24A and downwardly-inclined distal portion 26A lies radially outward middle portion 24A.

Rotatable platter 12A includes a recess 50A adapted to receive cartridge 40A. Recess 50A also preferably includes platter electrodes 52A and 53A adapted to make electrical contact with cartridge electrodes 42A and 43A when cartridge 40A is inserted into platter recess 50A. As with the previous embodiment, rotation of platter 12A generates a radially outwardly acting force 36A urging fluid 30A into distal portion 26A of switch 10A and into contact with pair of spaced electrical contacts 28A and 29A (see FIG. 3). Force 36A is proportional to the rate of rotation of platter 12A, and as a threshold rate of rotation is achieved, the value of force 36A becomes sufficient to displace fluid 30A from proximal portion 22A to distal portion 26A and into electrical contact with spaced electrical contacts 28A and 29A, thus completing an external electrical circuit (not shown) coupled to platter electrodes 52A and 53A. After rotational forces 36A have tripped switch 10A, switch 10A may be reset by orienting cartridge 40A such that fluid 30A returns to proximal portion 22A. This may be accomplished by automatically reorienting cartridge 40A while in platter recess 50A, or by manually removing cartridge 40A from platter recess 50A and orienting cartridge 40A such that fluid 30A flows from distal portion 26A.

Figure 5:
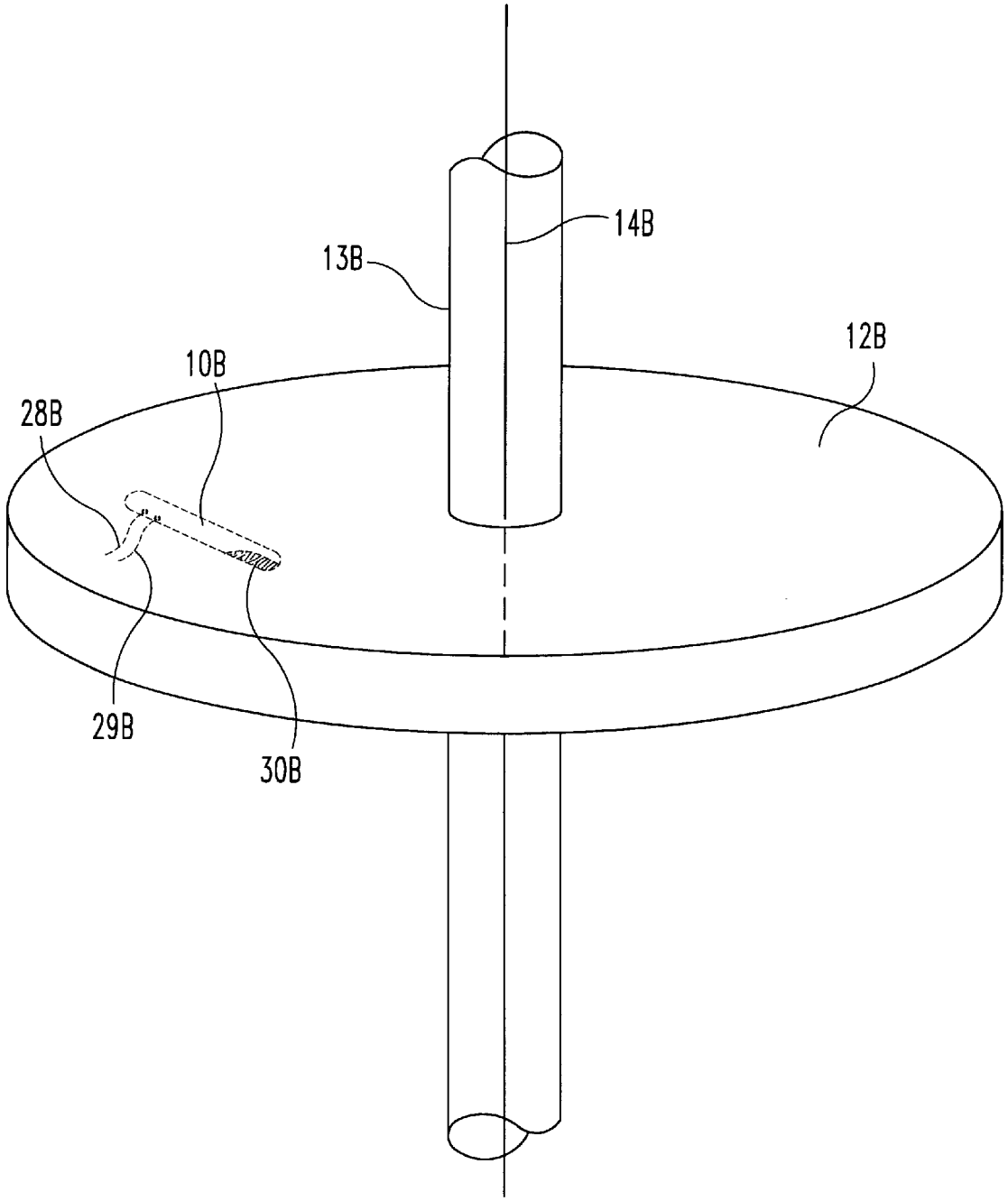
FIG. 5 is a perspective schematic view of a rotatable platter containing a third electrical switch embodiment of the present invention.
Figure 6A:
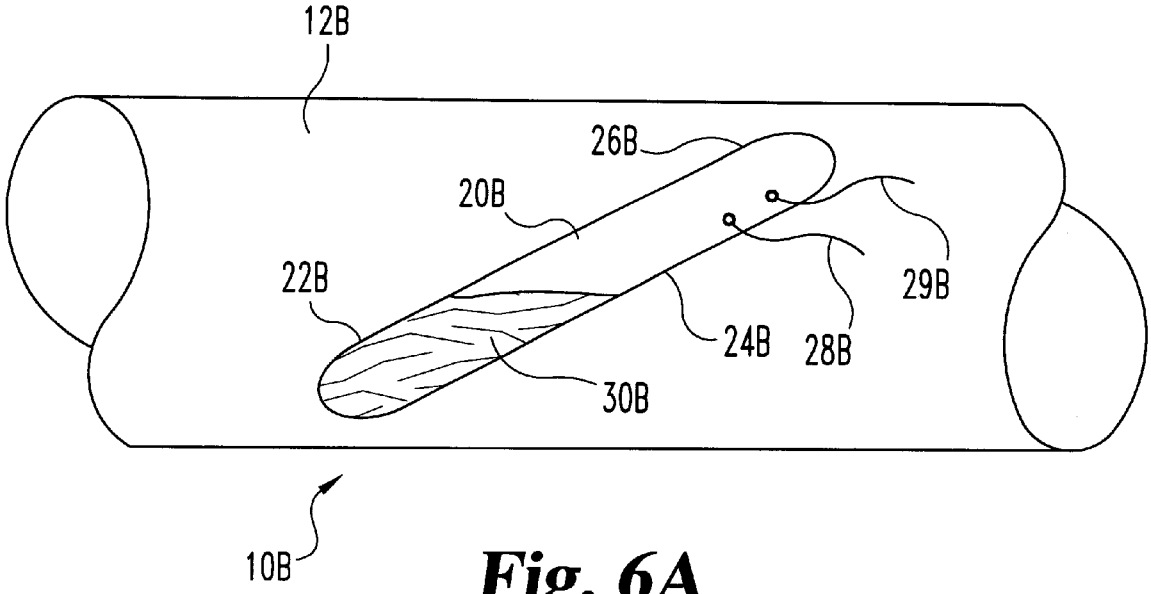
FIG. 6A is a cross-sectional illustration of the electrical switch of the of FIG. 5 having electrically conducting fluid occupying a first position.

FIGS. 5 and 6 illustrate yet another embodiment of the present invention, a rotation-actuated electrical switch 10B positionable in a rotatable platter 12B, wherein switch 10B has a generally linear configuration. FIG. 5 illustrates the preferred positioning of switch 10B within platter 12B. Rotatable platter 12B is preferably generally circular, and is more preferably generally planar and includes a primary axis of rotation 14B oriented substantially perpendicular to the plane of platter 12B. Switch 10B is preferably positioned within platter 12B, but may also be attached externally thereto by any convenient means. Switch 10B preferably extends generally radially outward from axis of rotation 14B and more preferably does not intersect axis of rotation 14B.

FIGS. 5 and 6 illustrate yet another embodiment of the present invention, a rotation-actuated electrical switch 10B positionable in a rotatable platter 12B, wherein switch 10B has a generally linear configuration. FIG. 5 illustrates the preferred positioning of switch 10B within platter 12B. Rotatable platter 12B is preferably generally circular, rotates about shaft 13B, and is more preferably generally planar and includes a primary axis of rotation 14B oriented substantially colinear with shaft 13B and substantially perpendicular to the plane of platter 12B. Switch 10B is preferably positioned within platter 12B, but may also be attached externally thereto by any convenient means. Switch 10B preferably extends generally radially outward from axis of rotation 14B and more preferably does not intersect axis of rotation 14B.

Switch 20B also includes a pair of spaced electrical contacts 28B, 29B adapted to electrically connect the interior of distal portion 26B to the exterior of switch 10B. Switch 10B further includes an electrically conducting fluid 30B (such as mercury or an aqueous electrolytic solution) partially filling enclosure 20B. Fluid 30B preferably rests in proximal portion 22B of switch 10B when platter 12B is at rest. Switch 10B is preferably oriented such that distal portion 26B is positioned generally radially outward from proximal portion 22B relative to axis of rotation 14B. More preferentially, switch 10B is also oriented such that proximal portion 22B is positioned below distal portion 26B such that while platter 12B is at rest, gravity acts to retain fluid 30B in proximal portion 22B.

Figure 6B:
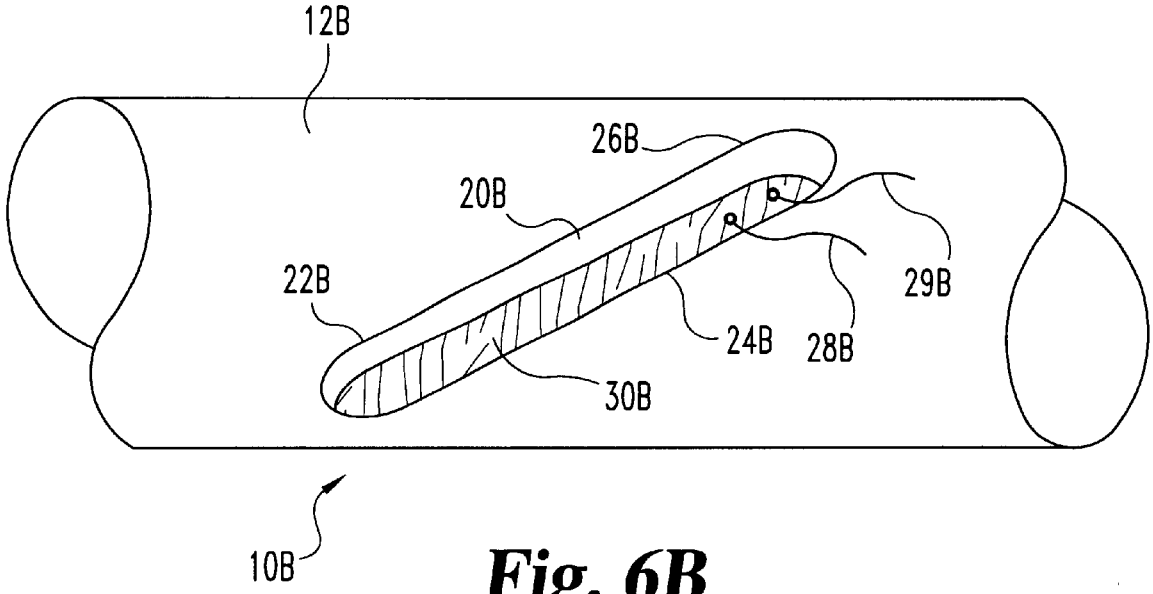

FIG. 6B illustrates the effects of rotation of platter 12B on switch 10B. Rotation of platter 12B generates a radially outwardly acting force (represented by arrow 36B) urging fluid 30B into distal portion 26B and into contact with the spaced electrical contacts 28B and 29B. Force 36B is proportional to the rate of rotation of platter 12B, such that when a threshold rate of platter 12B rotation is achieved, force 36B becomes sufficient to displace fluid 30B from proximal portion 22B into distal portion 26B and thus into electrical contact with spaced electrical contacts 28B and 29B to complete an external electrical circuit (not shown).

The rate of rotation at which fluid 30B becomes displaced into distal portion 26B may be predetermined by varying the amount of fluid 30B in enclosure 20B, the composition (specifically, the viscosity and/or density) of fluid 30B, varying the inclination of enclosure 20B with respect to the plane of platter 12B, and/or varying the positioning of electrical contacts 28B and/or 29B within distal portion 26B. Generally, as the density and/or viscosity of fluid 30B increases, a greater force 36B will be required to displace fluid 30B into distal portion 26B. Likewise, as the inclination of enclosure 20B becomes steeper, a greater force 36B will be required to displace fluid 30B into distal portion 26B. Moreover, the farther the electrical contacts 28B and 29B are positioned from proximal portion 22B, the greater the amount of force 36B necessary to move fluid 30B into electrical communication therewith. The precise rotational rate at which fluid 30B electrically connects electrical contacts 28B and 29B may therefore be determined by choosing the appropriate inclination of enclosure 20B, the appropriate amount and composition of fluid 30B, and/or the appropriate positioning of electrical contacts 28B and 29B in distal portion 26B in the appropriate combination.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are to be desired to be protected.

What is claimed is:

1. An apparatus for automatically closing an electrical circuit, comprising:

a generally circular generally planar rotatable platter having a primary axis of rotation substantially perpendicular to the plane of the platter;

a substantially arcuate enclosure defining a cavity and having a proximal portion, a middle portion, and a distal portion and connected to the platter;

a pair of spaced electrical contacts electrically connecting the interior of the distal portion of the cavity to an exterior of the cavity;

an electrically conducting fluid partially filling the cavity;

wherein the pair of spaced electrical contacts are adapted to be electrically connected to a circuit exterior to the cavity desired to be actuated by spinning the platter;

wherein the distal portion is oriented generally radially outward from the proximal portion relative to the primary axis of rotation;

wherein the proximal portion and the distal portion are positioned below the middle portion;

wherein rotation of the platter generates a radially outwardly acting force urging the fluid into the distal portion of the cavity and into contact with the pair of spaced electrical contacts.

2. The apparatus of claim 1, wherein the primary axis of rotation of the platter does not intersect the cavity.

3. The apparatus of claim 1, wherein the electrically conducting fluid is mercury.

4. An electrical switch actuated by rotation, comprising:

a rotatable platter having a central axis of rotation;

a generally arched compartment connected to the platter and having an upper middle portion, an inner leg portion, and an outer leg portion;

a first electrical lead extending through the outer leg of the compartment;

a second electrical lead spaced apart from the first electrical lead and extending through the outer leg of the compartment; and an electrically conducting fluid partially filling the compartment;

wherein rotation of the platter beyond a predetermined threshold rate will generate sufficient angular momentum to urge the electrically conducting fluid into the outer leg of the compartment.

5. The switch of claim 4, wherein the generally arched compartment is oriented substantially in a plane containing the axis of rotation of the platter.

6. The switch of claim 5, wherein the inner leg of the compartment is positioned closer to the axis of rotation of the platter than the outer leg of the compartment.

7. The switch of claim 4, wherein the platter is generally circular.

8. The switch of claim 4, wherein rotation of the platter urges the electrically conducting fluid into electrical contact with the first electrical lead and the second electrical lead in the outer leg of the compartment to complete an electrical circuit.

9. The apparatus of claim 1 wherein the substantially arcuate enclosure is integral with the generally circular generally planar rotatable platter.

10. The apparatus of claim 1 wherein the substantially arcuate enclosure is distinct from the generally circular generally planar rotatable platter.

11. A method of automatically detecting rotation, comprising the steps of:

a) providing a rotatable platter having an axis of rotation;

b) providing an elongated enclosure having a radially inner elongated portion and a radially outer elongated portion formed therein;

c) partially filling the radially inner elongated portion with an electrically conducting fluid;

d) connecting the elongated enclosure to the rotatable platter;

e) positioning the elongated enclosure relative to the rotatable platter such that the radially inner elongated portion is upwardly inclined;

f) extending a pair of spaced electrical leads from the radially outer elongated portion of the enclosure;

g) rotating the platter to generate sufficient angular momentum to urge the electrically conducting fluid into electrical contact with the spaced electrical leads.

12. An electrical switch for automatically closing a circuit in a rotating platter, comprising:

a rotatable platter;

a recess formed in the rotatable platter;

a first pair of electrical contacts formed in the recess;

a cartridge adapted to engage the recess;

an elongated cavity formed in the cartridge and having a proximal portion and a distal portion;

a second pair of spaced electrical contacts extending from the distal portion and adapted to electrically engage the first pair of electrical contacts;

an electrically conducting fluid partially filling the cavity;

wherein the fluid is adapted to rest in the proximal end when the platter is at rest; and wherein the fluid is adapted to make electrical contact with the second pair of electrical contacts when the platter is rotated beyond a predetermined threshold rate.

13. The switch of claim 12 wherein the cavity further includes a middle portion connecting the proximal portion and the distal portion.

14. The switch of claim 12 wherein the primary axis of rotation of the platter does not intersect the cavity.

15. An electrical switch, comprising:

a rotatable platter having an axis of rotation;

a generally linear enclosure operationally coupled to the platter and having an upper distal portion and a lower proximal portion;

a pair of electrical connections extending through the distal portion; and an electrically conducting fluid partially filling the enclosure;

wherein spinning the platter in excess of a predetermined threshold rate of rotation will generate sufficient angular momentum to urge the electrically conducting fluid into the distal portion.

16. The switch of claim 15, wherein the generally linear enclosure is oriented substantially in a plane containing the axis of rotation of the platter.

17. The switch of claim 16, wherein the proximal portion is positioned closer to the axis of rotation than the distal portion.

18. The switch of claim 15, wherein the platter is generally circular.

* * * * *